United States Patent [19]

Petursson

[11] Patent Number: 4,478,367

[45] Date of Patent: Oct. 23, 1984

[54] SHOWER PULSATOR

[75] Inventor: Sigurdur G. Petursson, Mississauga, Canada

[73] Assignee: Waltec Inc., Cambridge, Canada

[21] Appl. No.: 422,028

[22] Filed: Sep. 23, 1982

[30] Foreign Application Priority Data

Dec. 10, 1981 [CA] Canada ..... 391946

[51] Int. Cl.[3] ..... B05B 1/08; B05B 3/16

[52] U.S. Cl. ..... 239/381

[58] Field of Search ..... 239/102, 381

[56] References Cited

U.S. PATENT DOCUMENTS

| | | | |
|---|---|---|---|
| 3,713,587 | 1/1973 | Carson | 239/383 |
| 3,734,410 | 5/1973 | Bruno | 239/102 |
| 3,929,287 | 12/1975 | Givler et al. | 239/102 |
| 4,018,385 | 4/1977 | Bruno | 239/102 |
| 4,026,470 | 5/1977 | Crist | 239/102 |
| 4,151,957 | 5/1979 | Gecewicz et al. | 239/381 |
| 4,204,646 | 5/1980 | Shames | 239/381 X |

FOREIGN PATENT DOCUMENTS

| | | |
|---|---|---|
| 978239 | 11/1975 | Canada . |
| 986162 | 3/1976 | Canada . |
| 1029066 | 4/1978 | Canada . |
| 1032578 | 6/1978 | Canada . |
| 1044731 | 12/1978 | Canada . |
| 1046107 | 1/1979 | Canada . |
| 1067122 | 11/1979 | Canada . |
| 1089897 | 11/1980 | Canada . |

*Primary Examiner*—Andres Kashnikow

*Attorney, Agent, or Firm*—Larson and Taylor

[57] ABSTRACT

A pulsating spray head is provided for attachment to a source of fluid under pressure, e.g. water, which is of simple construction and provides for effective pulsations. The head comprises a housing in which is mounted a body portion which is closed off by a primary plate having a plurality of rows of radially extending perforations. A pulse disc is retained within the body portion and has a conical face resting on the primary plate. Fluid flow through the body portion causes the disc to roll around on the primary plate and sequentially block the rows of perforations in the primary plate whereby pressure fluctuations are caused in fluid exiting the primary plate. In a preferred embodiment, an orifice plate is secured in spaced relation to the primary plate to form at least one pressure chamber therebetween. There is always a base pressure within each pressure chamber and rotation of the disc causes pressure fluctuations to be superimposed on this base pressure to cause pressure variations in the fluid exiting the orifice plate.

8 Claims, 11 Drawing Figures

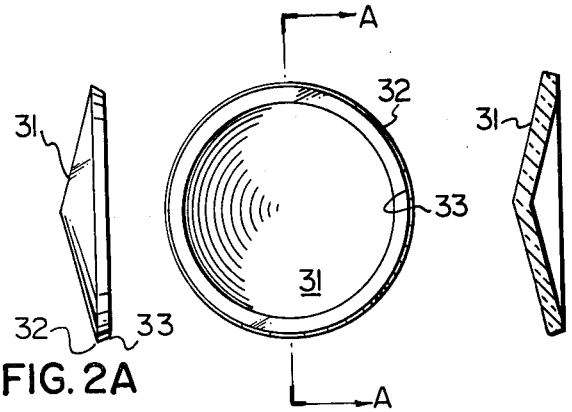
FIG. 2A
FIG. 2B
FIG. 2C
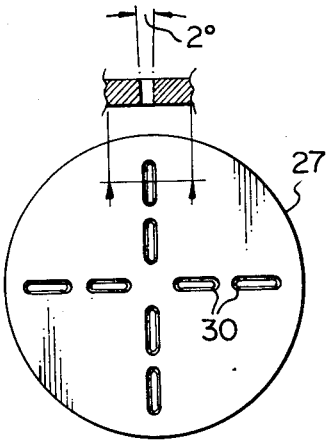
FIG. 3
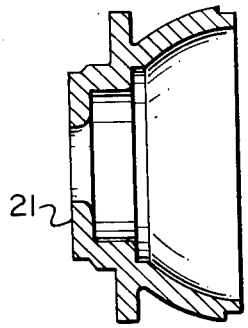
FIG. 4
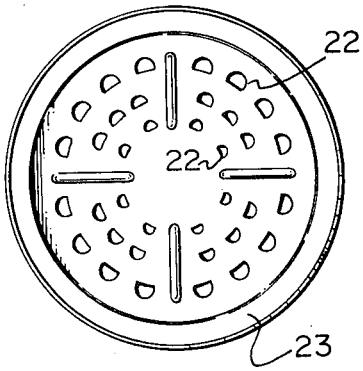
FIG. 5A
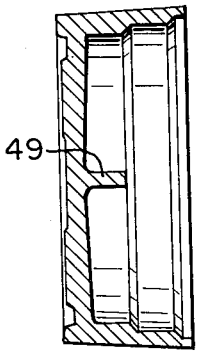
FIG. 5B

SHOWER PULSATOR

BACKGROUND OF THE INVENTION

This invention relates to a pulsating spray head for attachment to a source of fluid under pressure, in particular water.

A number of prior art pulsating spray heads are known, some using a swash plate and others using rotors. Some of these are quite complex or do not provide effective pressure fluctuations.

U.S. Pat. No. 3,734,410 of Bruno issued May 22, 1973 discloses a spray head which uses an oscillating plate (swash plate) mounted on a perforated cover. Water pressure causes the plate to oscillate and, as it oscillates, it sequentially blocks holes around the periphery of the cover. As only holes near the periphery can be blocked by the oscillating plate, large scale pressure fluctuations are not possible. The present invention uses a rolling conical disc which, as it rolls, substantially blocks radially extending holes in a plate. The structure is simple and enables effective pressure fluctuations.

Canadian Pat. No. 1,029,066 of Givler issued Apr. 4, 1978 discloses one arrangement which uses an oscillating plate with a projection which rests on the upper surface of a spray head. However, the plate can only block holes near the periphery of the spray head, unlike the present invention which can block an entire radially extending row of holes to provide effective pressure fluctuations.

Canadian Pat. No. 986,162 of Deines et al. issued Mar. 23, 1976 discloses the use of a hollow cylindrical valve rotor with turbine blades. The present invention does not require any turbine blades and is simpler than the structure disclosed by this patent.

SUMMARY OF THE INVENTION

According to the present invention, there is provided a pulsating spray head for attachment to a source of fluid under pressure. The head comprises a housing having an inlet and an outlet and a hollow annular body portion mounted in the housing, the body portion also having an inlet and an outlet. The outlet of the body portion is closed by a primary plate having a plurality of perforations. A pulse disc is retained within the body portion and has a conical face resting on the primary plate. Fluid flow through the body portion causes the disc to roll around on the primary plate and sequentially block the perforations in the primary plate whereby pressure fluctuations are caused in fluid exiting the primary plate.

The perforations are preferably arranged in rows, e.g. four rows, 90° apart.

A preferred embodiment further comprises an orifice plate secured in spaced relation to the primary plate whereby at least one pressure chamber is formed between the primary plate and the orifice plate, rolling of the disc causing pressure fluctuations to be superimposed on a base pressure within the chamber (or chambers).

BRIEF DESCRIPTION OF THE DRAWING

The invention will now be further described in conjunction with the accompanying drawings, in which:

FIG. 2A is a side view of a pulse disc which may be used in the present invention, FIG. 2B is a bottom view of the disc, FIG. 2C is a cross-sectional view of the disc along the line A—A of FIG. 2B, FIG. 3 is a top view of the primary plate, FIG. 4 is a cross-sectional view of the body portion, FIG. 5A is a top view of the orifice plate, FIG. 5B is a cross-sectional view of the orifice plate along a diameter thereof.

DESCRIPTION OF THE PREFERRED EMBODIMENTS

Figure 1:
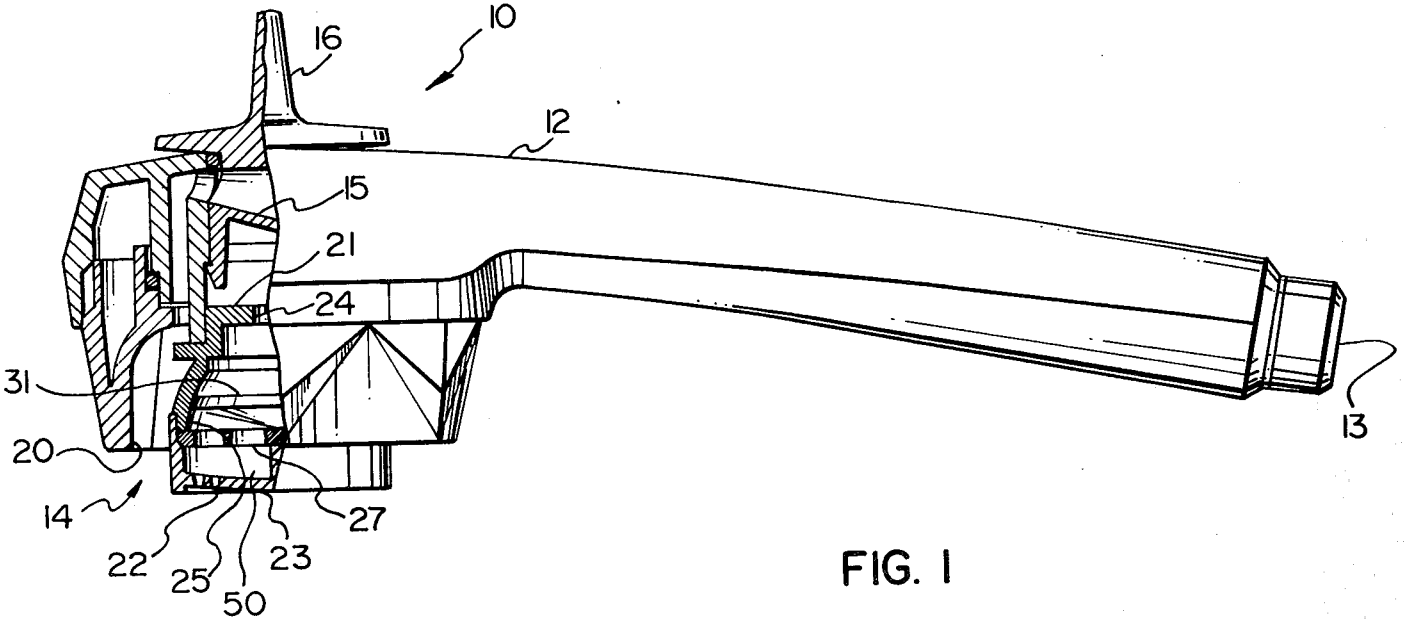
FIG. 1 is a view, partially in cross-section, of a pulsating spray head according to the invention.

Referring to FIG. 1, the pulsating spray head according to the invention is generally indicated at 10 and is seen to include a housing 12 having an inlet 13 and an outlet 14. A diverter 15 is mounted within the housing 12 and is rotatable by means of a knob 16. In the position shown, water flows directly to the outlet at 20 whereas, upon rotation of knob 16 by, for example, 90°, water is diverted through the body portion 21 of the spray head and passes through holes in a plate 27 covering the outlet of the body portion 21, and eventually exits through holes 22 in an orifice plate 23 provided in the preferred embodiment. The body portion 21 has an inlet 24 and an outlet 25.

The plate 27, best seen in FIG. 3, has a plurality of rows of radially extending perforations 30, in this case four rows of perforations 30. As shown in the cutaway portion of FIG. 3, the holes in the plate may be slightly tapered from inlet to outlet, e.g. by 2°.

Referring again to FIG. 1, a pulse disc 31 is retained within the body portion 21, it having a conical face resting on the primary plate 27. One type of disc which may be used is shown in FIGS. 2A to 2C and it will be seen that the edge of the disc tapers from 32 to 33 so that it may pivot without binding within the body portion 21, the inner surface of which is spherically shaped. The diameter of the spherically shaped innerface of the body portion 21 is slightly greater than the diameter of the disc, so that the disc may freely roll around within the body portion 21 upon the application of fluid pressure. The theory as to why fluid flowing through the structure causes the disc to roll is not fully understood but tests have shown that it does, in fact, roll.

FIG. 2C indicates that the disc is concave but a solid disc could also be used.

In the preferred embodiment, the orifice plate 23 is secured in spaced relation to the primary plate 27, the orifice plate 23 having holes 22 of various sizes, as illustrated in FIG. 5A, and upstanding radially extending walls 49 which form four chambers 50 between the primary plate 27 and the orifice plate 23. It will be appreciated that as the disc rolls, it can only block one radially extending row of holes 30 at a time, so that the remaining rows of holes in the primary plate 27 allow fluid to flow into the pressure chambers 50. Thus, there is always some pressure in the pressure chambers 50 which results in fluid exiting the orifices 22 in orifice plate 23. Superimposed on what may be termed a base pressure, however, are pressure fluctuations caused as the rolling disc sequentially blocks the radially extending holes 30 in the primary plate 27. The base pressure in some cases could be atmospheric, but usually it would be considered to be advantageous to be above atmospheric as would be expected because the conical disc does not block the holes 30 completely as it rolls over them.

The holes 30 in the primary plate 27 and the holes 22 in the orifice plate 23 have been illustrated as being arranged in four quadrants (four pressure chambers) but more or fewer groups of holes could be used if desired. There should be a balanced relationship between the total area of inlet holes to the total areas of outlet holes for each chamber.

The housing, body portion, disc, primary plate and the orifice plate may all be formed of plastic.

The theory of why the disc of FIGS. 2A–2C will roll around is one of analysing the forces involved. There is a relatively high pressure $P_H$ on the upstream top surface of the disc. The restriction of water flowing past the disc causes a downstream reduced pressure $P_I$ between the underside of the disc and the primary plate. There is a flow of water out of the area under the disc through the holes 30 in the primary plate. Due to the initial turbulence the disc will tend to roll in one direction or the other, but which every way it starts then the flows and forces will cause it to continue to roll in that direction. The pressure $P_H$ will be fairly uniformly distributed on the top surface of the disc. The pressure $P_I$ will not be uniformly distributed for the initial movement of the disc will allow the water to flow "horizontally" to fill the "void" caused by the movement. Some of the water will tend to pass through the holes 30 and so give a further decrease in pressure as well as a direction of movement of the water towards these holes 30. Thus, there is established a horizontal component of the flowing water under the disc which will tend to increase the pressure (in the direction of flow) on the underside of the disc due to the velocity head in the horizontal direction. The resultant pressures acting on the disc will then tend to roll the disc as there is in effect a greater downward force on the area of disc forward of the conical line of contact in the direction of rolling than there is behind the conical line of contact. This is a continuing situation and so the rolling action initiated is increased until such speed of rolling is obtained as will have the activating forces and losses balanced.

Figure 6A:
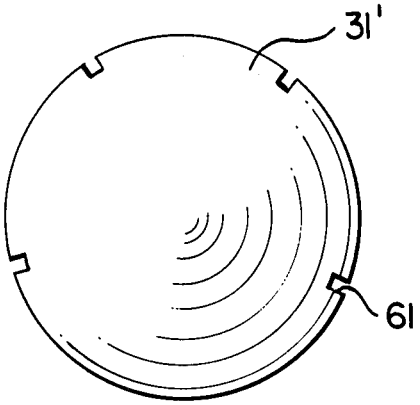
FIGS. 6A, 6B and 6C are bottom, top and side views, respectively, of a preferred form of disc for use in a spray head according to the invention.
Figure 6B:
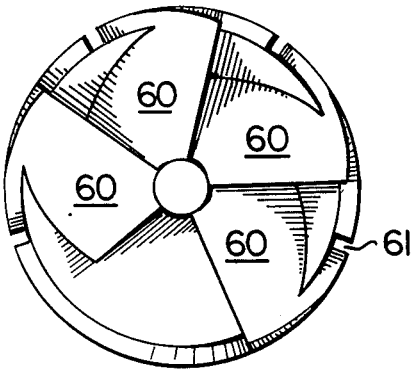
Figure 6C:
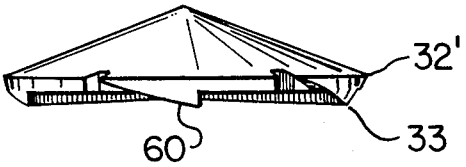

A preferred form of disc is shown in FIGS. 6A–6C and is designated 31'. As in the embodiment of FIGS. 2A–2C it has a conical bottom face and its edge tapers from 32' and 33'. However, the top face is provided with a number of vanes 60 which have sloping top surfaces so that incoming water reacts with the vanes to always cause the disc to roll in one direction. Also, the disc tends to roll more easily in starting because the vanes "pick up" the force of the flowing water more easily. The slots 61 allow water to flow past the disc after reacting with the vanes.

The invention is not to be limited in any way by the above theory which is, however, believed to be essentially correct. Whatever the correct theory, the invention does work.

Although the drawings illustrate a handshower, the invention is also applicable to fixed showerheads. Furthermore, the term "pulsating spray head" is not to be restricted to heads used in air because they could also be used underwater to provide a pulsating stream which would not necessarily have an aerated system.

What is claimed is:

1. A pulsating spray head for attachment to a source of fluid under pressure, comprising:

a housing having an inlet and an outlet, a hollow annular body portion mounted in said housing and also having an inlet and an outlet, a flat primary plate having a plurality of perforations arranged in radially extending rows and which closes the outlet of said body portion, a pulse disc being retained within said body portion and having a conical face resting on said primary plate, fluid flow through said body portion causing said conical face of said disc to roll around on said primary plate and sequentially block the perforations in the primary plate whereby pressure fluctuations are caused in fluid exiting the head via the perforations in the primary plate, and an orifice plate being secured in spaced relation to said primary plate whereby at least one pressure chamber is formed between said primary plate and said orifice plate, rolling of said disc causing pressure fluctuations to be superimposed on a base pressure within each chamber.

2. A pulsating spray head as claimed in claim 1 wherein there are four rows of perforations, 90° apart, in said primary plate.

3. A pulsating spray head as claimed in claim 2 wherein a part of said body portion adjacent its outlet is spherically shaped to accommodate rolling movement of the pulse disc, said spherically shaped part having a radius of curvature slightly larger than the radius of the disc.

4. A pulsating spray head as claimed in claim 3 wherein said disc is formed of plastic.

5. A pulsating spray head as claimed in claim 1 wherein upstanding radially extending walls divide the space between the primary plate and the orifice plate into a plurality of pressure chambers.

6. A pulsating spray head as claimed in claim 3 wherein upstanding radially extending walls divide the space between the primary plate and the orifice plate into a plurality of pressure chambers.

7. A pulsating spray head as claimed in claim 1 or 3 wherein said disc has a top provided with vanes having sloping top surfaces whereby the disc is caused to rotate in a predetermined direction by flow of said fluid.

8. A pulsating disc as claimed in claim 5 or 6 wherein said disc has a top provided with vanes having sloping top surfaces whereby the disc is caused to rotate in a predetermined direction by flow of said fluid.

* * * * *